US006267532B1

(12) United States Patent
Persson

(10) Patent No.: US 6,267,532 B1
(45) Date of Patent: Jul. 31, 2001

(54) HANDLE ASSEMBLY FOR A VIBRATING COMPACTOR

(75) Inventor: Gert Persson, Lyckeby (SE)

(73) Assignee: Svedala Compaction Equipment AB, Karlskrona (SE)

( * ) Notice: Subject to any disclaimer, the term of this patent is extended or adjusted under 35 U.S.C. 154(b) by 0 days.

(21) Appl. No.: 09/497,257

(22) Filed: Feb. 3, 2000

(30) Foreign Application Priority Data

Feb. 3, 1999 (SE) ..... 9900360

(51) Int. Cl.[7] ..... E01C 19/32; B25G 1/01

(52) U.S. Cl. ..... 404/133.1; 404/133.05; 81/489; 56/DIG. 18

(58) Field of Search ..... 404/102, 114, 404/118, 131, 133.05, 133.1; 451/350; 15/22.1; 81/489; 56/DIG. 18

(56) References Cited

U.S. PATENT DOCUMENTS 2,671,915 * 3/1954 Fraser et al. ..... 15/22.1
3,283,677 * 11/1966 Uebel ..... 404/133.1
3,782,845 1/1974 Briggs et al. .
4,388,018 6/1983 Boschung .
4,892,437 * 1/1990 Kraft ..... 404/97
5,695,389 * 12/1997 Bartel et al. ..... 451/92
5,857,803 * 1/1999 Davis et al. ..... 404/102
5,984,571 * 11/1999 Owens ..... 404/97

FOREIGN PATENT DOCUMENTS 0054529 6/1982 (EP) .

* cited by examiner

*Primary Examiner*—Thomas B. Will
*Assistant Examiner*—Gary S. Hartmann
(74) *Attorney, Agent, or Firm*—Walter Ottesen

(57) ABSTRACT

A vibrating compactor is equipped with a handle assembly (20) in which the vibrations are damped via vibration dampers (8) with an arrangement to limit the resilient movement of the vibration dampers. The handle assembly includes a lower section (5) and an upper section (9) joined by the vibration dampers. The lower section of the handle assembly is provided with through spindles (11) which can be positioned and tightened in elongated through openings (10) in the lower section. The spindles (11) extend through corresponding oblong holes (12) in the upper section (9) of the handle assembly. The holes (12) each widen toward one end and narrow toward the other end.

3 Claims, 3 Drawing Sheets

HANDLE ASSEMBLY FOR A VIBRATING COMPACTOR

FIELD OF THE INVENTION

The invention relates to a handle assembly for a self-propelled vibrating compactor. With the handle assembly of the invention, the degree of vibration damping is limited when the compactor is operated manually to compact wet surfaces such as surfaces of clay and particularly when working on upward slopes.

BACKGROUND OF THE INVENTION

All known vibrating compactors are equipped with vibration-damped handles which utilize vibration dampers of various kinds to insulate the operator from vibration generated by the compactor. These vibration dampers are the softest possible rubber elements or springs to enable them to provide maximum damping effect. When compacting wet surfaces and especially when working on upward slopes, the operator is obliged to push the compactor with the handle to achieve mobility. Because of their softness, the vibration damping elements are thereby strained beyond permissible limits and their service life shortened significantly.

SUMMARY OF THE INVENTION

It is an object of the invention to eliminate the disadvantages of known vibrating compactors by providing the vibration dampers with an arrangement to limit the extent to which the vibration dampers are stretched and subjected to unwanted stress.

The handle assembly of the invention is for a vibrating compactor having a chassis. The handle assembly defines a longitudinal axis and includes: an elongated lower channel section having mutually adjacent channel side walls; a pivot joint for pivotally connecting the lower channel section to the chassis; an elongated upper channel section having mutually adjacent channel side walls; a plurality of vibration dampers connected between the upper channel and the lower channel; first and second through slot means extending in the direction of the axis and formed in the channel side walls of the lower channel section, respectively; a first spindle adjustably attached to the lower section in the first and second through slot means; a second spindle adjustably attached to the lower section in the first and second through slot means; the upper channel section likewise having mutually adjacent channel side walls disposed adjacent corresponding ones of the channel side walls of the lower channel section; a first set of oblong holes formed in the channel side walls of the upper channel section, respectively, for accommodating the first spindle; a second set of oblong holes formed in the side walls of the upper channel section for accommodating the second spindle; each of the oblong holes defining a longitudinal axis extending in the direction of the longitudinal axis of the handle assembly and having a first longitudinal end having a narrow width and a second longitudinal end having a widened width; and, each one of the spindles being displaceable in the first and second slot means so as to be disposed at the first longitudinal end or the second longitudinal end or anywhere between the longitudinal ends of the oblong holes.

According to another feature of the invention, the first slot means comprises two elongated through openings formed in one of the side walls of the lower channel for accommodating corresponding ones of the first and second spindles; and, the second slot means comprising two elongated through openings formed in the other one of the side walls of the lower channel for accommodating corresponding ones of the first and second spindles.

The upper and lower sections are shaped channel sections and are joined by four soft rubber elements. The above object is achieved by providing the upper and lower sections of the handle with two spindles passing laterally through the sections. The lower section of the handle is provided with two elongated through holes on either side. The spindles can be tightened in the desired position in the elongated through holes with the holes being aligned in the longitudinal direction of the handle assembly.

The upper section of the handle is provided with corresponding holes, oblong in shape but widening towards one end, through which the spindles extend. A lesser limit is imposed on the movement (and stress) of the vibration dampers when the spindles in the elongated through holes in the lower section of the handle are adjusted so that they are aligned with the center of the widened region of the oblong holes in the upper section of the handle.

On the other hand, the movement (and stress) of the vibration dampers is virtually completely restricted when the spindles in the elongated through holes in the lower section of the handle are adjusted so that they are aligned with the center of the non-widened or narrow region of the oblong holes in the upper section of the handle assembly. The movement of the vibration dampers can be limited in a continuously variable manner by varying the position of the spindles between the two above-mentioned end positions in the oblong holes.

In normal operation, therefore, in which the operator is required to apply only a light force to move the machine forward, the vibration of the handle assembly is well damped. However, when compacting wet materials or clays (that is, when the operator is required to apply a greater force to control the machine), control must be achieved without straining and stressing the vibration dampers beyond permissible limits of the material of which the vibration dampers are made.

According to another feature of the invention, the position of the handle assembly relative to the chassis of the compactor can be adjustably set by means of a locking device to one of three positions, namely, normal working position, half raised position and fully raised position.

BRIEF DESCRIPTION OF THE DRAWINGS

The invention will now be described with reference to the drawings wherein.

DESCRIPTION OF THE PREFERRED EMBODIMENT OF THE INVENTION

Figure 1:
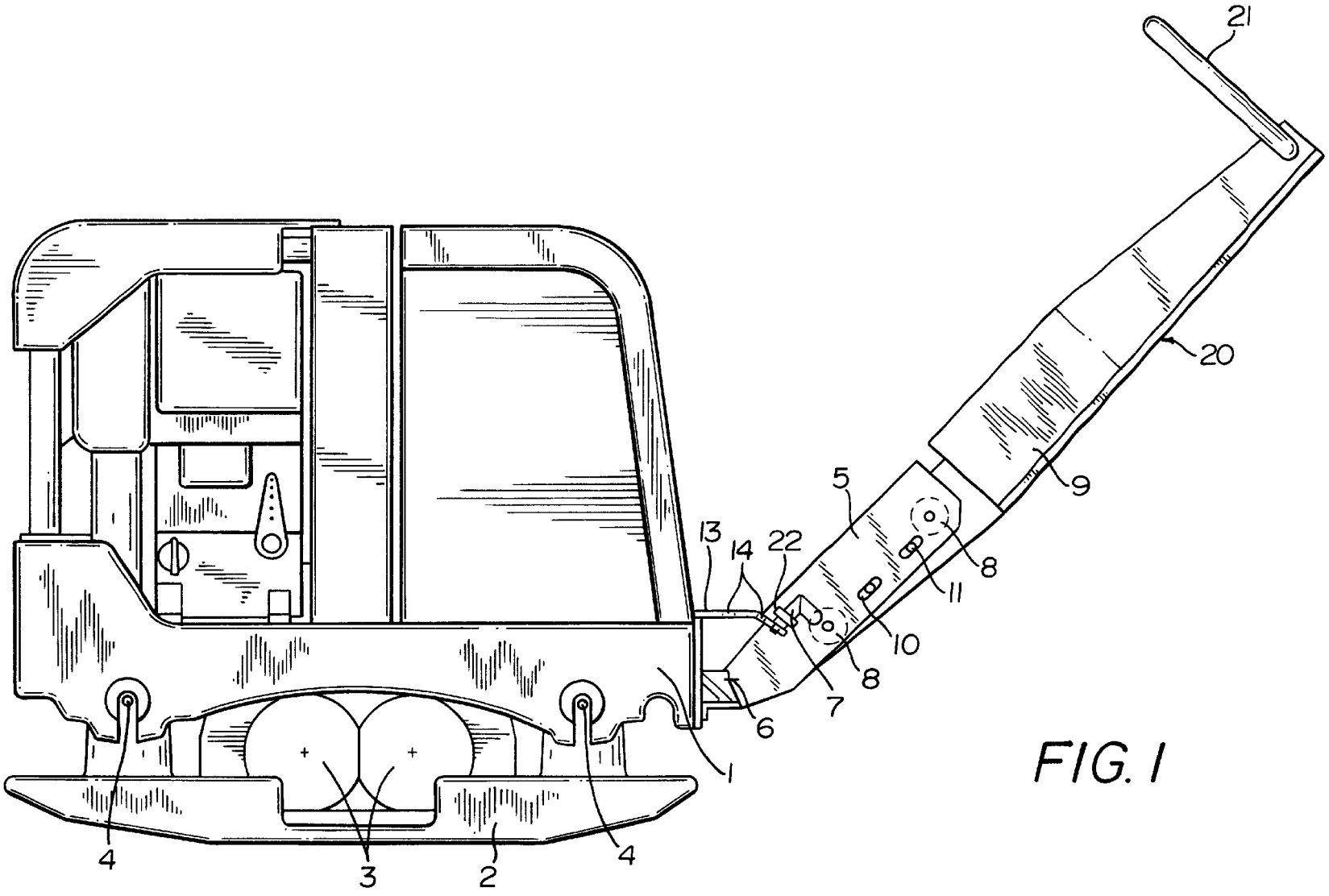
FIG. 1 is a side elevation view of a vibrating compactor according to an embodiment of the invention.

In FIG. 1, the vibratory base plate 2 of the vibrating compactor is provided with eccentric elements 3 attached to the chassis 1 via four vibration dampers 4. A handle assembly 20 includes a handle 21 for the operator. The lower section 5 of the handle assembly 20 is attached to the chassis 1 by a pivot joint which includes the fulcrum pin 6.

A locking pin unit 7 has a spring-biased locking pin 22 and a locking plate 13 having holes 14 to permit the handle assembly 20 to be angularly adjusted relative to the chassis 1. The locking pin 22 engages in any one of the holes 14 thereby locking the handle assembly at different positions such as normal working position (shown in FIG. 1), half raised position and fully raised position (that is, a vertical position). Reference numeral 24 identifies a mounting bracket for holding the locking pin unit 7 on the lower section 5.

Figure 3:
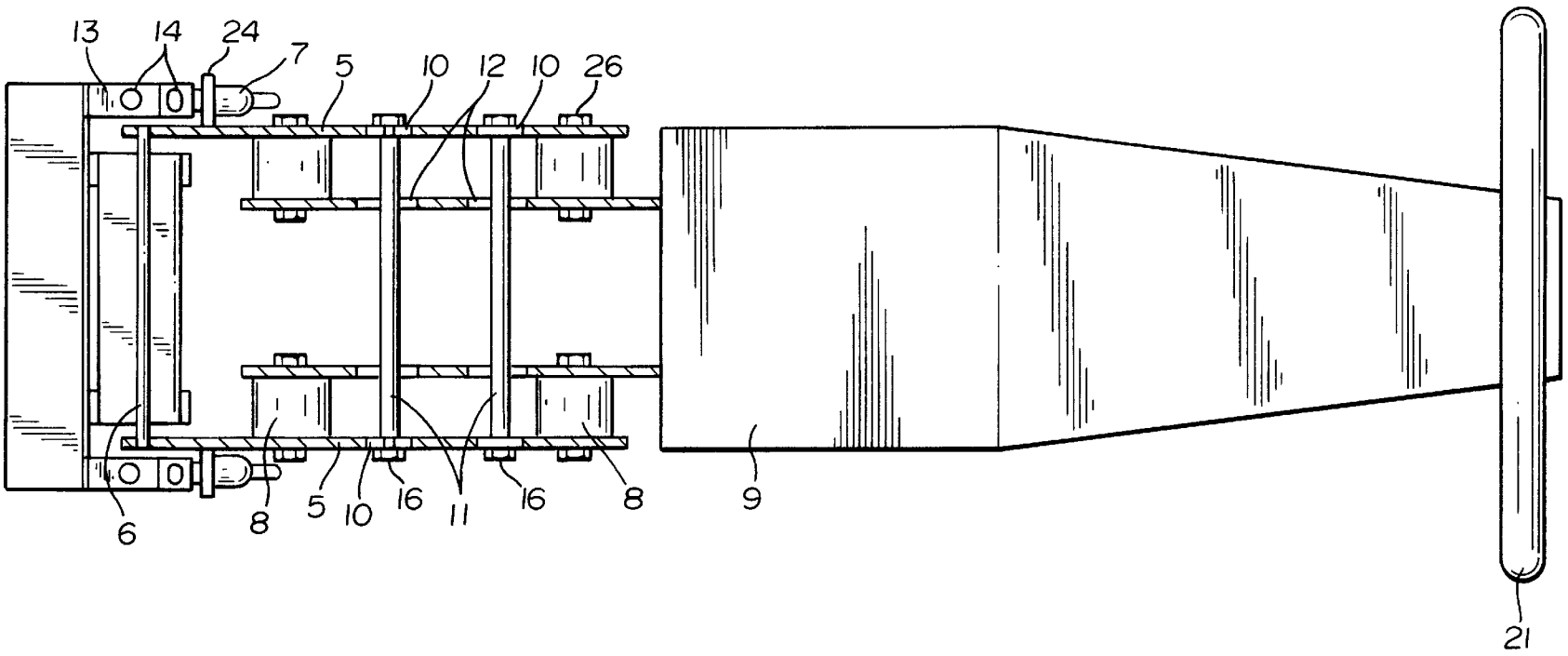

The lower section 5 of the handle assembly 20 is a channel section inside of which four soft vibration dampers 8 are mounted utilizing bolts 26. The dampers 8 are, in turn, attached with the bolts 26 to the lower end of the upper section 9 of the handle assembly as shown in FIG. 3. The upper section 9 is also a channel section.

Each side wall of the lower channel section 5 of the handle assembly 20 is provided with two elongated through openings 10 aligned longitudinally in the direction of the handle assembly as shown. Two spindles 11 extend laterally through the handle assembly and are provided with threaded ends and locknuts 16 to enable them to be tightened in position in the elongated through openings or slots 10. In lieu of separate slots 10 for each spindle, a single long slot (not shown) could be provided in each side wall of lower channel section 5.

Figure 2:
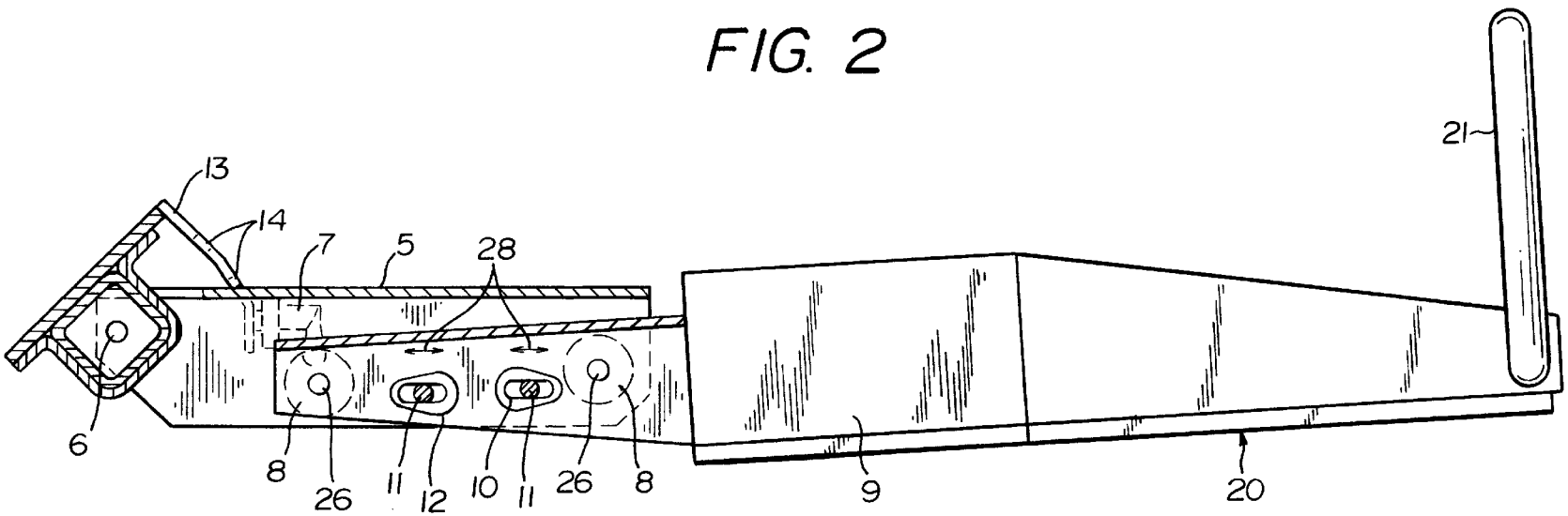
FIG. 2 is a side elevation view, partially in section, of the handle assembly of the vibrating compactor shown in FIG. 1; and, FIG. 3 is a plan view, partially in section, of the handle assembly of FIG. 2.

FIG. 2 shows a vertical cross section through the lower section 5 and the lower end of the upper section 9 of the handle assembly 20 and shows the respective holes 12 in the side walls of the upper section 9 through which the spindles 11 extend. The holes 12 are oblong in shape and widen toward one end and narrow toward the other end. The respective positions of the spindles 11 in the slots 10 (and therefore in the oblong openings 12) can be adjusted in the direction indicated by double arrow 28 in FIG. 2.

FIG. 3 is a horizontal cross section through FIG. 2 and shows the spindles 11 fixed in position in the elongated through openings 10 in the lower section 5 of the handle assembly 20 and extending through the oblong holes 12 in the upper section 9 of the handle assembly.

It is understood that the foregoing description is that of the preferred embodiments of the invention and that various changes and modifications may be made thereto without departing from the spirit and scope of the invention as defined in the appended claims.

What is claimed is:

1. A handle assembly for a vibrating compactor having a chassis, the handle assembly defining a longitudinal axis and comprising:

an elongated lower channel section having mutually adjacent channel side walls;

a pivot joint for pivotally connecting said lower channel section to said chassis;

an elongated upper channel section having mutually adjacent channel side walls;

a plurality of vibration dampers connected between said upper channel and said lower channel;

first and second through slots extending in the direction of said axis and formed in said channel side walls of said lower channel section, respectively;

a first spindle adjustably attached to said lower section in said first and second through slots, a second spindle adjustably attached to said lower section in said first and second through slots;

said upper channel section having mutually adjacent channel side walls disposed adjacent corresponding ones of said channel side walls of said lower channel section;

a first set of oblong holes formed in said channel side walls of said upper channel section, respectively, for accommodating said first spindle;

a second set of oblong holes formed in said side walls of said upper channel section for accommodating said second spindle;

each of said oblong holes defining a longitudinal axis extending in the direction of said longitudinal axis of said handle assembly and having a first longitudinal end having a narrow width and a second longitudinal end having a widened width; and, each one of said spindles being displaceable in said first and second slots so as to be disposed at said first longitudinal end or said second longitudinal end or anywhere between said longitudinal ends of said oblong holes.

2. The handle assembly of claim 1, wherein said first slot comprises two elongated through openings formed in one of said side walls of said lower channel for accommodating corresponding ones of said first and second spindles; and, said second slot comprising two elongated through openings formed in the other one of said side walls of said lower channel for accommodating corresponding ones of said first and second spindles.

3. The handle assembly of claim 1, further comprising a device for positioning said handle assembly relative to said chassis in any one of several angular positions; said device including: a locking plate mounted on said chassis and said locking plate having a plurality of holes corresponding to said angular positions, respectively; and, a spring-loaded pin mounted on said lower channel section for selectively engaging any one hole of said plurality of holes.

* * * * *